US011105252B2

(12) United States Patent
Lee et al.

(10) Patent No.: US 11,105,252 B2
(45) Date of Patent: Aug. 31, 2021

(54) COOLING APPARATUS OF PISTON AND CONTROL METHOD THEREOF

(71) Applicants: HYUNDAI MOTOR COMPANY, Seoul (KR); KIA MOTORS CORPORATION, Seoul (KR)

(72) Inventors: Tae Won Lee, Incheon (KR); Jae Man Cho, Hwaseong-si (KR); Hong Kil Baek, Seoul (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 16/924,322

(22) Filed: Jul. 9, 2020

(65) Prior Publication Data

US 2021/0108553 A1 Apr. 15, 2021

(30) Foreign Application Priority Data

Oct. 15, 2019 (KR) ..... 10-2019-0127696

(51) Int. Cl.

| | |
|---|---|
| ***F01M 1/16*** | (2006.01) |
| ***F01P 3/08*** | (2006.01) |
| ***F01P 3/10*** | (2006.01) |
| ***F02F 3/18*** | (2006.01) |
| *F01P 3/00* | (2006.01) |

(52) U.S. Cl.

CPC ..... *F01P 3/10* (2013.01); *F02F 3/18* (2013.01); *F01P 2003/006* (2013.01); *F01P 2025/04* (2013.01); *F01P 2025/62* (2013.01); *F01P 2025/64* (2013.01)

(58) Field of Classification Search

CPC .. F01M 1/08; F01M 1/16; F01M 5/002; F01P 3/08; F01P 2003/006

See application file for complete search history.

(56) References Cited

U.S. PATENT DOCUMENTS

| | | | | |
|---|---|---|---|---|
| 5,881,684 | A * | 3/1999 | Bontaz | F01P 3/08 123/41.35 |
| 7,735,462 | B2 * | 6/2010 | Obermeier | F02F 3/26 123/41.35 |
| 2015/0027400 | A1 * | 1/2015 | Adelmann | F01P 3/10 123/193.6 |
| 2015/0285126 | A1 * | 10/2015 | Stellwagen | F01M 1/08 123/41.42 |
| 2016/0230640 | A1 * | 8/2016 | Kamimura | F01M 11/02 |
| 2017/0284455 | A1 * | 10/2017 | Kim | F16J 1/16 |
| 2017/0342891 | A1 * | 11/2017 | Ha | F01M 1/16 |
| 2017/0350304 | A1 * | 12/2017 | Yamashita | F01P 7/14 |

FOREIGN PATENT DOCUMENTS

DE 102017206152 A1 * 10/2018 ..... F01M 1/08

OTHER PUBLICATIONS

Google translation of DE102017206152A1 (Year: 2018).*

* cited by examiner

*Primary Examiner* — Long T Tran

(74) *Attorney, Agent, or Firm* — McDonnell Boehnen Hulbert & Berghoff LLP

(57) ABSTRACT

A cooling apparatus of a piston according to an exemplary embodiment of the present disclosure may include a piston configured to be formed with a cooling gallery, an inlet fluidly communicated with the cooling gallery, and an outlet fluidly communicated with the cooling gallery, therein, a first oil jet configured to inject cooling oil into the inlet, and a second oil jet configured to inject cooling oil into the outlet.

4 Claims, 4 Drawing Sheets

COOLING APPARATUS OF PISTON AND CONTROL METHOD THEREOF

CROSS REFERENCE TO RELATED APPLICATIONS

This application claims priority to and the benefit of Korean Patent Application No. 10-2019-0127696 filed in the Korean Intellectual Property Office on Oct. 15, 2019, the entire contents of which are incorporated herein by reference.

BACKGROUND

(a) Field

The present disclosure relates to a cooling apparatus of a piston and a method thereof. More particularly, the present disclosure relates to a cooling apparatus of a piston equipped with a plurality of oil jets that inject cooling oil of different flow rates into a cooling gallery in the piston and a control method thereof.

(b) Description of the Related Art

In general, a piston cooling oil jet (PCJ: piston cooling oil jet) is a device for maintaining the heat resistance and durability of a piston by lowering the temperature of the piston exposed to high temperature and high pressure by injecting cooling oil into the piston.

In order to improve the cooling efficiency of the piston, the filling ratio of the cooling gallery formed in the piston and flowing cooling oil (e.g., engine oil) must be maintained at an appropriate level (e.g., 30-60%).

However, conventionally, there is only one oil jet injecting cooling oil into the cooling gallery of the piston.

Therefore, if the oil jet is designed based on when the engine speed is in a high-speed condition, the amount of cooling oil injected through the oil jet in a low-speed condition is high, thereby exceeding the appropriate filling ratio of the cooling gallery. Due to this, the amount of cooling oil flowing through the cooling gallery increases, and the cooling efficiency of the piston is deteriorated.

Conversely, if the oil jet is designed based on when the engine speed is in a low-speed condition, the cooling oil injected through the oil jet in a high-speed condition is less, thereby falling short the appropriate filling ratio of the cooling gallery. Due to this, the amount of cooling oil flowing through the cooling gallery is too small, and the cooling efficiency of the piston is deteriorated.

Therefore, it is necessary to improve the cooling performance of the piston by maintaining the appropriate filling ratio in the cooling gallery in entire speed regions of the engine.

The above information disclosed in this Background section is only for enhancement of understanding of the background of the disclosure, and therefore it may contain information that does not form the prior art that is already known in this country to a person of ordinary skill in the art.

SUMMARY

The present disclosure has been made in an effort to provide a cooling apparatus of a piston and a method thereof improving cooling performance of the piston by maintaining the filling ratio in the cooling gallery of the piston in the entire speed region of an engine to an appropriate level.

A cooling apparatus of a piston according to an exemplary embodiment of the present disclosure may include a piston configured to be formed with a cooling gallery, an inlet fluidly communicated with the cooling gallery, and an outlet fluidly communicated with the cooling gallery, therein, a first oil jet configured to inject cooling oil into the inlet, and a second oil jet configured to inject cooling oil into the outlet.

An amount of cooling oil injected by the first oil jet may be larger than an amount of cooling oil injected by the second oil jet.

The amount of cooling oil injected by the first oil jet may be 1.3 times-2.7 times of the amount of cooling oil injected by the second oil jet.

A cooling apparatus of a piston according to an exemplary embodiment of the present disclosure may further include a controller configured to control operation of the first oil jet and the second oil jet based on an engine speed, and an engine load according to the engine speed or a combustion pressure.

The controller may control the first oil jet to inject cooling oil, and stop operation of the second oil jet when the engine speed is greater than a predetermined speed.

The controller may control the second oil jet to inject cooling oil, and stop operation of the first oil jet when the engine speed is less than a predetermined speed.

The controller may stop operation of the first oil jet and the second oil jet when the engine load according to the engine speed is less than a predetermined load or the combustion pressure is less than a predetermined pressure.

A method of controlling a cooling apparatus of a piston including a first oil jet injecting cooling oil into a cooling gallery formed in the piston, a second oil jet injecting relatively small amount of cooling oil into the cooling gallery comparing to the first oil jet according to another exemplary embodiment of the present disclosure, the method may include, by a driving information detector, detecting an engine speed, and an engine load according to the engine speed or a combustion pressure in a combustion chamber, and by a controller, controlling operation of the first oil jet and the second oil jet based on the engine speed and the engine load according to the engine speed, or the engine speed and the combustion pressure.

Operations of the first oil jet and the second oil jet may be stopped when the engine load according to the engine speed is less than a predetermined load or the combustion pressure is less than a predetermined pressure.

The cooling oil may be injected through the first oil jet, and the operation of the second oil jet is stopped when the engine load according to the engine speed is greater than the predetermined load and the engine speed is greater than a predetermined speed, or the combustion pressure is greater than a predetermined pressure and the engine speed is greater than a predetermined speed.

The cooling oil may be injected through the second oil jet and the operation of the first oil jet is stopped when the engine load according to the engine speed is greater than the predetermined load and the engine speed is less than a predetermined speed, or the combustion pressure is greater than a predetermined pressure and the engine speed is less than a predetermined speed.

The cooling apparatus of the piston and its control method according to an exemplary embodiment of the present disclosure as described above are provided with two oil jets that inject cooling oil at different flow rates into the cooling gallery, and the two oil jets that controlled based on engine speed and combustion pressure, thereby maintaining appropriate filling ratio in the cooling gallery.

And by maintaining the filling ratio in the cooling gallery of the piston at an appropriate level, it is possible to improve the cooling performance of the piston.

BRIEF DESCRIPTION OF THE FIGURES

The drawings are intended to be used as references for describing the exemplary embodiments of the present disclosure, and the accompanying drawings should not be construed as limiting the technical spirit of the present disclosure.

DETAILED DESCRIPTION

Figure 1:
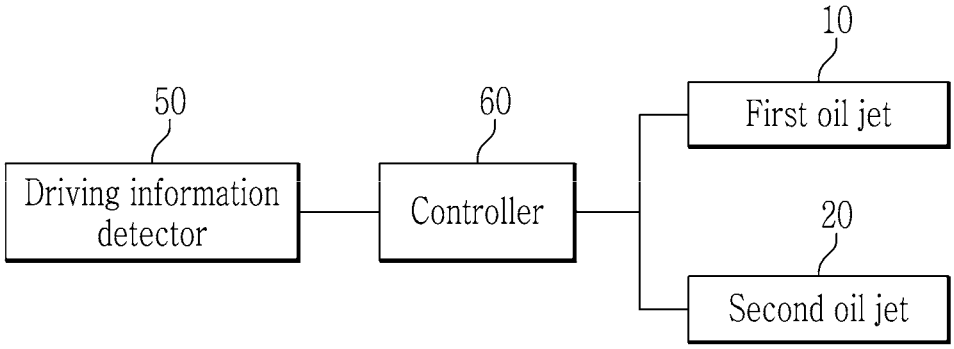
FIG. 1 is a block diagram illustrating a cooling apparatus of a piston according to an exemplary embodiment of the present disclosure.

The present disclosure will be described more fully hereinafter with reference to the accompanying drawings, in which exemplary embodiments of the disclosure are shown. As those skilled in the art would realize, the described embodiments may be modified in various different ways, all without departing from the spirit or scope of the present disclosure.

The drawings and description are to be regarded as illustrative in nature and not restrictive, and like reference numerals designate like elements throughout the specification.

Also, the size and thickness of each element are arbitrarily shown in the drawings, but the present disclosure is not necessarily limited thereto, and in the drawings, the thickness of layers, films, panels, regions, etc., are exaggerated for clarity.

Hereinafter, a cooling apparatus of a piston according to an exemplary embodiment of the present disclosure is described in detail reference to the drawings.

Figure 2:
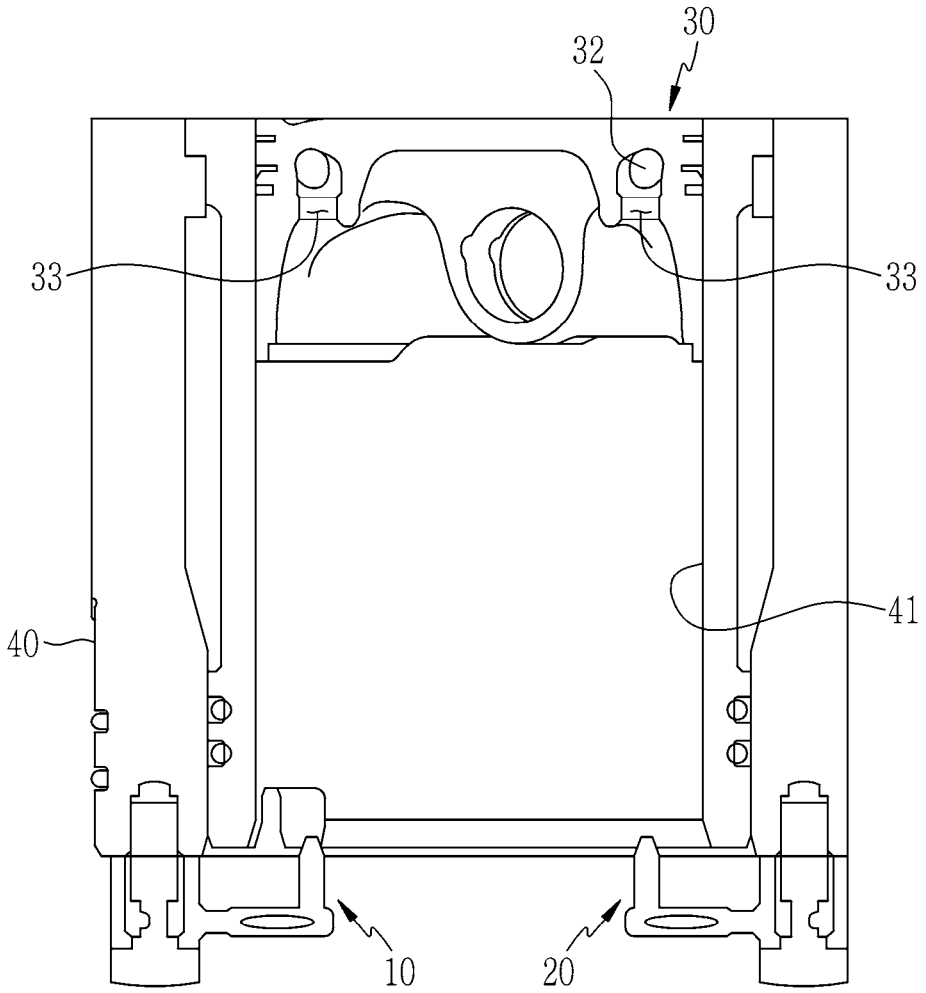
FIG. 2 is a cross-sectional view of a piston according to an exemplary embodiment of the present disclosure.

FIG. 1 is a block diagram illustrating a cooling apparatus of a piston according to an exemplary embodiment of the present disclosure. FIG. 2 is a cross-sectional view of a piston according to an exemplary embodiment of the present disclosure.

As shown in FIGS. 1 and 2, a cooling apparatus of a piston according to an exemplary embodiment of the present disclosure may include a piston 30, a first oil jet 10, and a second oil jet 20.

The piston 30 compresses intake air and fuel inflowing from the outside by reciprocal movement up and down in a combustion chamber 41 formed in a cylinder block 40.

A cooling gallery 32 in which cooling oil flows is formed in the piston 30. In addition, an inlet 31 fluidly communicated with the cooling gallery 32 and an outlet 33 fluidly communicated with the cooling gallery 32 are formed in the piston 30. Cooling oil (e.g., engine oil) flows in the cooling gallery 32 through the inlet 31 or outlet 33, and flows out from the cooling gallery 32 through the inlet 31 or outlet 33.

The first oil jet 10 injects cooling oil flowing through a main gallery formed in a cylinder block 40 into the inlet 31. When the first oil jet 10 injects the cooling oil into the inlet 31, the cooling oil injected by the first oil jet 10 flows through the cooling gallery 32 and is exhausted to the outlet 33.

The second oil jet 20 injects cooling oil flowing through a main gallery formed in a cylinder block 40 into the outlet 33. When the second oil jet 20 injects the cooling oil into the outlet 33, the cooling oil injected by the second oil jet 20 flows through the cooling gallery 32 and is exhausted to the inlet 31.

That is, the inlet 31 and the outlet 33 may also function as an outlet and an inlet, respectively, if necessary.

In this disclosure, an amount of the cooling oil injected by the first oil jet 10 may be greater than an amount of the cooling oil injected by the second oil jet 20. The amount of cooling oil injected by the first oil jet 10 may be set to 1.3 times-2.7 times of the amount of cooling oil injected by the second oil jet 20. To this end, the size of a nozzle (not shown) formed on the first oil jet 10 may be larger than the size of the nozzle formed on the second oil jet 20.

The cooling apparatus of the piston according to an exemplary embodiment of the present disclosure may further include a controller 60 controls operation of the first oil jet 10 and the second oil jet 20 based on an engine speed, and engine load (or, engine torque), and a combustion pressure in the combustion chamber.

The controller 60 may be provided as at least one processor operable by a predetermined program, where the predetermined program may include instructions to respective steps of a method of controlling the cooling apparatus of the piston according to an exemplary embodiment.

The engine speed and the combustion pressure may be detected by a driving information detector 50, the engine speed and the combustion pressure detected by the driving information detector 50 may be transmitted to the controller 60. The driving information detector 50 may include a speed sensor for detecting the engine speed and a combustion pressure sensor for detecting the combustion pressure in the combustion chamber 41. The driving information detector 50 may calculate the engine load (or, engine torque) based on an opening amount of APS (acceleration pedal sensor), the engine speed, and an intake air amount detected by an air flow meter.

Hereinafter, an operation of the cooling apparatus of the piston according to an exemplary embodiment of the present disclosure will be described in detail with reference to accompanying drawings.

Figure 3:
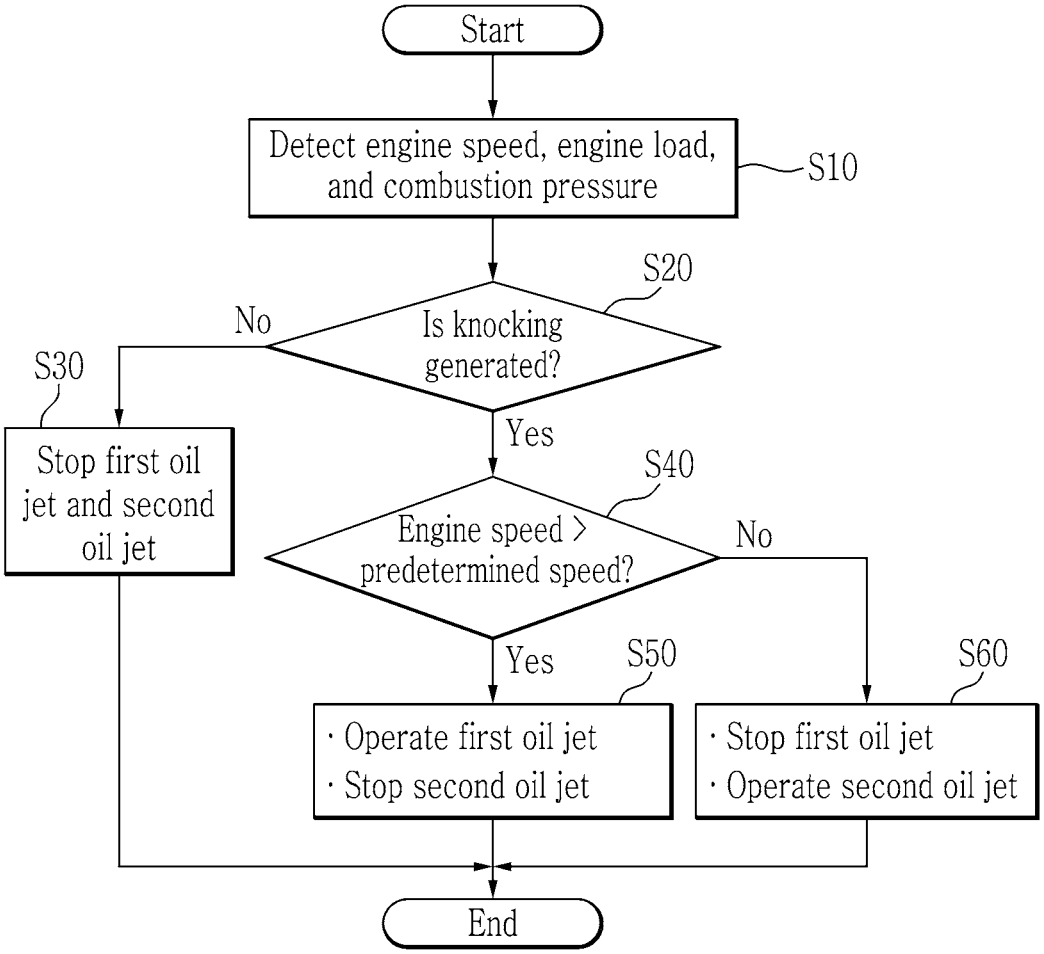
FIG. 3 is a flowchart illustrating an operation of a cooling apparatus of a piston according to an exemplary embodiment of the present disclosure.

FIG. 3 is a flowchart illustrating an operation of a cooling apparatus of a piston according to an exemplary embodiment of the present disclosure.

Referring to FIG. 3, the driving information detector 50 detects the engine speed, the engine load, and the combustion pressure in the combustion chamber 41, and transmits the engine speed, the engine load, and the combustion pressure detected by the driving information detector 50 to the controller 60 at step S10.

The controller 60 may determine whether knocking is generated in the combustion chamber 41 at step S20. When knocking is not generated in the combustion chamber 41, the controller 60 stops the operation of the first oil jet 10 and the second oil jet 20, and cooling oil is not injected into the cooling gallery 32 of the piston 30 at step S30. The controller 60 may determine whether knocking is generated from the combustion pressure or the engine load according the engine speed. For example, the controller 60 may determine that knocking is not generated in the combustion chamber 41 when the combustion pressure is less than a predetermined pressure, or the engine load according to the engine speed is less than a predetermined load.

When the combustion pressure is lower than the predetermined pressure or the engine load according to the engine speed is less than the predetermined load, it means that the possibility of knocking inside the combustion chamber 41 is very low, and therefore it is not necessary to inject cooling oil into the cooling gallery 32 of the piston 30. Rather, in this case, when the cooling oil is injected to the piston 30, the temperature of the piston 30 is excessively lowered, which may cause a problem that the engine efficiency decreases. Therefore, when the combustion pressure is low or the engine load according to the engine speed is less than the predetermined load, it is preferable not to inject cooling oil into the piston 30.

At the step S30, when the engine load according to the engine speed is greater than the predetermined load, or the combustion pressure is greater than the predetermined pressure, the controller 60 determines whether the engine speed is greater than a predetermined speed at step S40. When the engine speed is greater than the predetermined speed (e.g., 2500 RPM), the controller 60 controls the first oil jet 10 to be operated such that the cooling oil is injected into the inlet 31 of the piston 30. And the controller 60 stops the operation of the second oil jet 20 at step S50.

When the engine is operated at high speed, since relatively large amount of cooling oil is injected into the inlet 31 by the first oil jet 10, relatively large amount of cooling oil flows through the cooling gallery 32 of the piston 30. Therefore, the filling ratio in the cooling gallery 32 (the amount of cooling oil compared to the volume of the cooling gallery) may be maintained at an appropriate level (e.g., 30-60%). Accordingly, cooling performance of the piston 30 may be improved (refer to FIG. 4).

At step S20, when the engine speed is less than the predetermined speed (e.g., 2500 RPM), the controller 60 operates the second oil jet 20 to inject cooling oil into the outlet 33 of piston 30. And the controller 60 stops the operation of the first oil jet at step S60.

When the engine is operated at low speed, since relatively small amount of cooling oil is injected into the outlet 33 by the second oil jet 20, relatively small amount of cooling oil flows through the cooling gallery 32 of the piston 30. Therefore, the filling ratio in the cooling gallery 32 (the amount of cooling oil compared to the volume of the cooling gallery) may be maintained at an appropriate level (e.g., 30-60%). Accordingly, cooling performance of the piston 30 may be improved (refer to FIG. 4).

Figure 4:
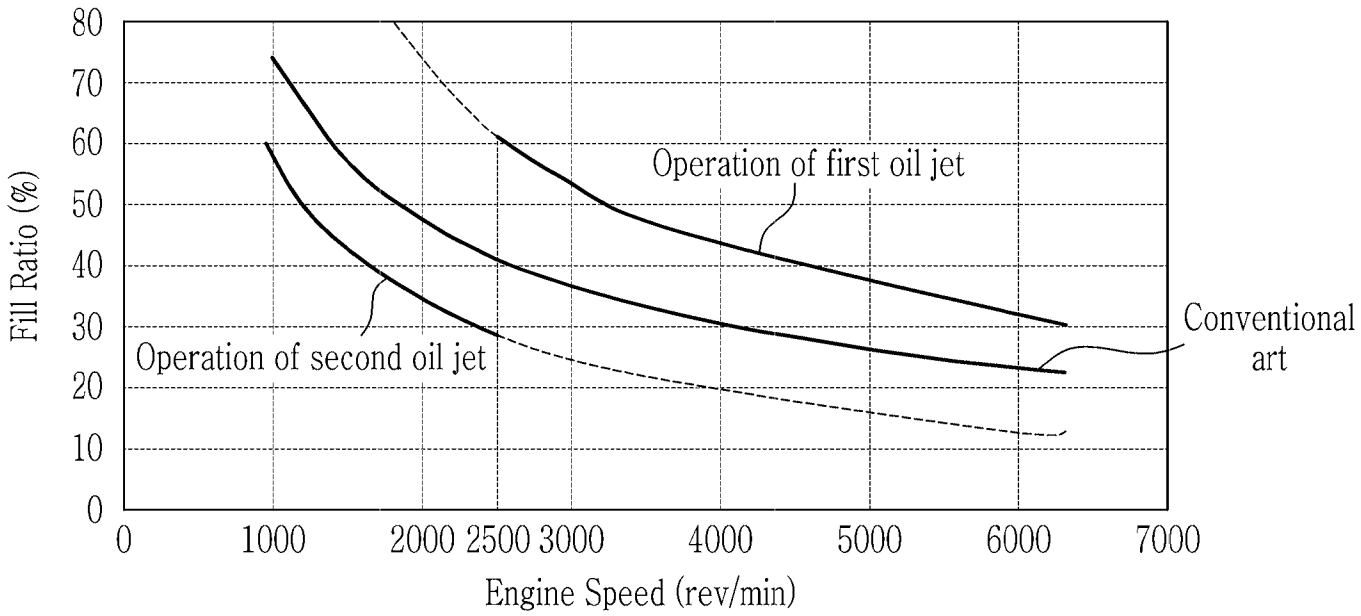
FIG. 4 is a graph explaining a performance of a cooling apparatus of a piston according to an exemplary embodiment of the present disclosure.

Referring to FIG. 4, according to conventional art, there is a case that the filling ratio is increased over an appropriate level at low-speed region, and the filling ratio is decreased below the appropriate level at high-speed region, by using only one oil jet.

However, according to an exemplary embodiment of the present disclosure, since the amount of cooling oil injected to the cooling gallery 32 is adjusted by the first oil jet 10 and the second oil jet 20 based on the engine speed and the combustion pressure, the filling ratio of cooling oil may be maintained at an optimal level in entire speed region, thereby improving cooling performance of the piston 30. Therefore, the possibility of knocking in the combustion chamber 41 in entire speed regions may be minimized.

While this disclosure has been described in connection with what is presently considered to be practical exemplary embodiments, it is to be understood that the disclosure is not limited to the disclosed embodiments. On the contrary, it is intended to cover various modifications and equivalent arrangements included within the spirit and scope of the appended claims.

The invention claimed is:

1. A cooling apparatus of a piston comprising:

a piston configured to be formed with a cooling gallery, an inlet fluidly communicated with the cooling gallery, and an outlet fluidly communicated with the cooling gallery, therein;

a first oil jet configured to inject cooling oil into the inlet;

a second oil jet configured to inject cooling oil into the outlet;

a controller configured to control operation of the first oil jet and the second oil jet based on an engine speed, and an engine load according to the engine speed or a combustion pressure;

wherein the controller controls the first oil jet to inject cooling oil, and stops operation of the second oil jet when the engine speed is greater than a predetermined speed;

wherein the controller controls the second oil jet to inject cooling oil, and stops operation of the first oil jet when the engine speed is less than a predetermined speed; and wherein the controller stops operation of the first oil jet and the second oil jet when the engine load according to the engine speed is less than a predetermined load or the combustion pressure is less than a predetermined pressure.

2. The cooling apparatus of claim 1, wherein an amount of cooling oil injected by the first oil jet is larger than an amount of cooling oil injected by the second oil jet.

3. The cooling apparatus of claim 2, wherein the amount of cooling oil injected by the first oil jet is 1.3 times-2.7 times of the amount of cooling oil injected by the second oil jet.

4. A method of controlling a cooling apparatus of a piston including a first oil jet injecting cooling oil into a cooling gallery formed in the piston, and a second oil jet injecting a relatively small amount of cooling oil into the cooling gallery compared to the first oil jet, the method comprising:

by a driving information detector, detecting an engine speed, and an engine load according to the engine speed or a combustion pressure in a combustion chamber; and by a controller, controlling operation of the first oil jet and the second oil jet based on the engine speed and the engine load according to the engine speed, or the engine speed and the combustion pressure;

wherein operations of the first oil jet and the second oil jet are stopped when the engine load according to the engine speed is less than a predetermined load or the combustion pressure is less than a predetermined pressure;

wherein the cooling oil is injected through the first oil jet, and the operation of the second oil jet is stopped when the engine load according to the engine speed is greater than the predetermined load and the engine speed is greater than a predetermined speed, or the combustion pressure is greater than a predetermined pressure and the engine speed is greater than the predetermined speed; and wherein the cooling oil is injected through the second oil jet and the operation of the first oil jet is stopped when the engine load according to the engine speed is greater than the predetermined load and the engine speed is less than a predetermined speed, or the combustion pressure is greater than a predetermined pressure and the engine speed is less than a predetermined speed.

* * * * *